United States Patent [19]

Lin et al.

[11] 4,042,775

[45] Aug. 16, 1977

[54] ELECTRICAL CONNECTIONS OF CONDUCTORS TO A BUS BAR

[75] Inventors: Kou Chi Lin, Sharon; LeRoy E. Dobson, Jamestown, both of Pa.

[73] Assignee: Westinghouse Electric Corporation, Pittsburgh, Pa.

[21] Appl. No.: 636,282

[22] Filed: Nov. 28, 1975

[51] Int. Cl.[2] ..... H01R 5/04; H01F 15/10

[52] U.S. Cl. ..... 174/94 R; 336/192

[58] Field of Search ..... 174/71 B, 72 B, 88 R, 174/88 B, 94 R; 339/275 R, 275 A; 336/192; 403/270, 271, 272; 29/628

[56] References Cited

U.S. PATENT DOCUMENTS 3,742,122 6/1973 Blavos et al. ..... 174/94 R

*Primary Examiner*—Laramie E. Askin

*Attorney, Agent, or Firm*—D. R. Lackey

[57] ABSTRACT

An electrical conductor connecting arrangement connecting a plurality of assembled conductors to each other and to an electrical bus bar. First and second electrical connector conductors have first portions connected to the electrical bus bar and second portions which extend outwardly from the bus bar with a spacing selected to snugly accommodate a dimension of the assembled conductors. The assembled conductors are disposed only between the second portions of the first and second electrical connector conductors, with the ends of the assembled conductors substantially aligned with selected flat surfaces of the first and second electrical connector conductors. A fusion of metal is disposed over the ends of the assembled conductors and adjoining flat surfaces of the first and second electrical connector conductors.

10 Claims, 5 Drawing Figures

ELECTRICAL CONNECTIONS OF CONDUCTORS TO A BUS BAR

BACKGROUND OF THE INVENTION

1. Field of the Invention

The invention relates in general to electrical connections, and more specifically to electrical connections of a plurality of electrical conductors to an electrical bus bar.

2. Description of the Prior Art

The individual coils of an electrical power transformer have a plurality of conductor turns, with the conductor of the coil including a plurality of assembled straps or conductors which have a generally rectangular cross-sectional configuration. The coils are interconnected to provide a transformer winding, and the ends of the winding are connected to electrical bus bars. The connection to the bus bar must interconnect the ends of the individual straps to one another, and to the bus bar, with a joint which is good mechanically as well as electrically. To avoid a high resistance region in the current path, the cross-sectional area of the connection must be at least equal to the cross-sectional area of the assembled coil conductor.

Connections made in high current transformers having copper conductors and bus bars are usually made by brazing the conductors directly to the bus bar. Copper brazing is performed by heating the straps and the bus bar terminal either with the incandescent or the gas torch method. A self-fluxing filler material, such as phos-copper or phos-silver is fed to the joint for solidifying the line leads to the bus bar terminal. Since the brazing temperature is in the range of 1202° to 1508° F, and the melting point for copper is 1,980° F, special temperature control is not required. This method forms an excellent connection because the brazing material readily flows between the conductor straps as well as between the bottom straps and the bus bar. The connection is completely solid.

Connections made in high current power transformers having aluminum conductors and bus bars are more complicated to make than connections in copper transformers. Brazing aluminum requires precise temperature control since the melting point of aluminum is only 100° to 150° F above the melting point of the brazing material. The allowable tolerance of the temperature is too low to permit satisfactory results in a production shop.

Brazing aluminum also requires the use of chemical flux materials to promote wetting action. Unfortunately, suitable fluxes are corrosive to the aluminum, with any residual flux trapped in the joint causing corrosion of the connection with degrades its electrical performance.

It has been found that arc welding by either the MIG (Metalic Inert Gas) or TIG (Tungsten Inert Gas) method provides a satisfactory electrical and mechanical connection for the aluminum members. When the number of conductor straps and the size of the conductor are sufficiently small, arc welding may be used to weld the ends and the edges of the aluminum straps directly to an aluminum bus bar. However, when the size of the conductor increases due to the number and/or size increase of the straps, the arc welding method of connecting the straps directly to the bus bar becomes impractical. This is due to low capillary action in aluminum welding, resulting in an extremely low build of weld material during each pass. As a general rule, the weld material should have a current carrying cross-sectional area equal to or greater than the cross-sectional area of the conductor. To achieve this, it is necessary to build up the weld material by making a plurality of passes with the welding electrode. The large number of passes required for aluminum welding the number and size of the conductor straps in a typical high current power transformer coil conductor to a bus bar makes the coil lead termination difficult, time consuming, and therefore very costly.

U.S. Pat. No. 3,742,122, which is assigned to the same assignee as the present application, discloses a new arrangement for making good mechanical and electrical connections between the straps of a multiple aluminum conductor, and an aluminum bus bar. This new and improved arrangement does not require an excessive weld buildup to achieve good electrical performance, regardless of the number and size of the assembled straps which make up the coil conductor. This new arrangement connects at least two aluminum partitions to the aluminum bus bar to define a channel, or a U-shaped fixture having upstanding partitions is fastened to the bus bar, which fixture defines a channel, and the assembled strap conductors are positioned in the channel with their ends substantially aligned with selected flat surfaces of the partitions. A fusion of metal, such as an alloy of aluminum, is applied across the aligned conductor ends and adjoining flat surfaces of the partitions by MIG or TIG welding.

The connecting arrangement in the hereinbefore mentioned U.S. patent is suitable for a large coil conductor having a large number of assembled strap conductors, but the U-shaped connector with the partitions and connecting base portion produces an objectionally bulky terminal for terminating smaller coil conductors, which conductors have fewer and smaller conductor straps. The U-shaped connector also must be premade with accurate channel widths, and since different transformer ratings utilize different numbers and sizes of strap conductors in the coil conductor, it is necessary to manufacture a relatively large number of different sizes of U-shaped connctors.

If the partitions are fastened directly to the bus bar, the resulting connection is still bulky for the smaller coil conductors, and, the welding of the partitions to the bus bar requires a high degree of skill to provide a channel which enables the coil conductor to snugly fit the channel without interference with fillet weld beads.

SUMMARY OF THE INVENTION

Briefly, the present invention is a new and improved electrical connecting arrangement which enables the aluminum straps of transformer coil conductors to be welded to an aluminum bus bar without requiring excessive buildup of weld material, and without requiring a bulky terminal, while providing a mechanically strong termination which is also good electrically. At least first and second aluminum connector conductors have selected first portions thereof welded directly to the aluminum bus bar at the time the electrical terminal is to be constructed, with second portions of these first and second connector conductors extending outwardly from the bus bar. The spacing of the connector conductors is selected for a predetermined outer cross-sectional dimension of the assembled strap conductors which are to be connected to the bus bar, eliminating the need for manufacturing different sizes of connector fixtures with accurately spaced partitions. Then the assembled conductors are placed only between the outwardly extending second portions, with the composite end of the coil conductor aligned with selected flat surfaces of the first and second connector conductors. A fusion of metal, such as an aluminum alloy, is then applied across the end of the straps which are assembled to provide the coil conductor, and across adjacent flat surfaces of the first and second connector conductors. Since the coil conductor is not placed between the first portions of the first and second connector conductors, the complete perimeter of the first portions may be welded to the bus bar, if desired, to provide the required mechanical and electrical joint.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF PREFERRED EMBODIMENTS

Figure 1:
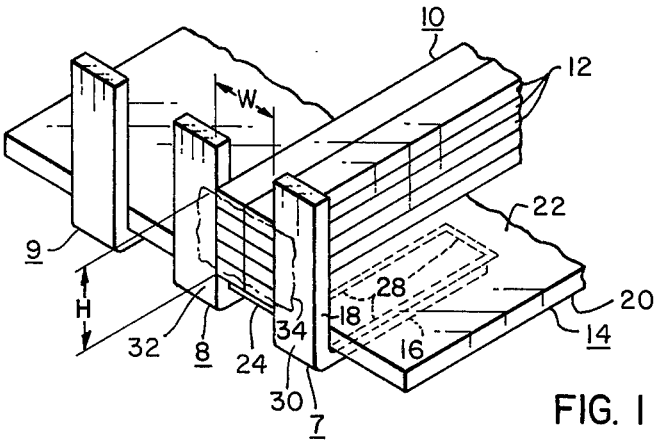
FIGS. 1, 2 and 3 are perspective views of electrical connections utilizing L-shaped connector conductors according to the embodiments of the invention.
Figure 2:
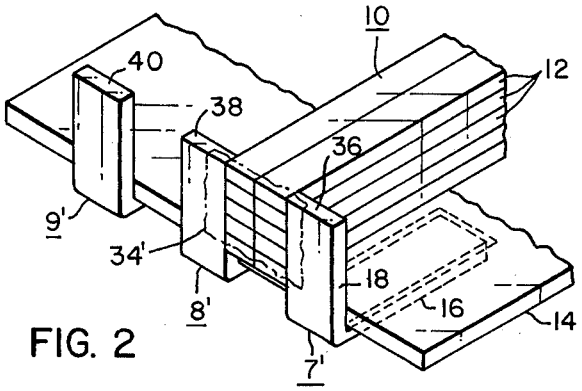
Figure 3:
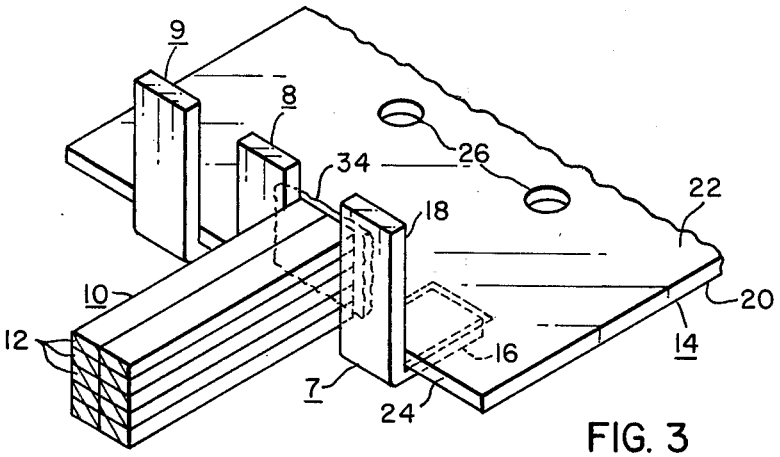

Referring now to the drawings, and FIGS. 1, 2 and 3 in particular, there are shown perspective views of conductor connections constructed according to embodiments of the invention which utilize a plurality of L-shaped aluminum connector conductors, such as L-shaped connector conductors 7, 8 and 9, to connect a coil conductor 10 having a plurality of assembled aluminum strap conductors 12 to an aluminum bus bar 14.

The plurality of strap conductors 12 of coil conductor 10 are assembled with their ends substantially aligned to define a substantially rectangularly shaped composite end portion having a width dimension W and a height dimension H.

Each of the L-shaped connector conductors, such as connector conductor 7, includes first and second leg portions 16 and 18, respectively.

The bus bar 14 is a heavy bar of aluminum having a rectangular cross-sectional configuration. Bus bar 14 includes first and second major opposed sides 20 and 22, respectively, and connecting side portions, such as side portion 24. Bus bar 14 includes a plurality of openings therein for receiving mounting hardware for securing electrical leads to the bus bar, such as openings 26 shown in the FIG. 3 embodiment.

The L-shaped connector conductors 7, 8 and 9 are oriented such that the first leg portion 16 contacts the first major side 20 of the bus bar 14, and the second leg portion proceeds past the side portion 24 and extends outwardly from the second major side 22 of the bus bar. The first portion 16 of each L-shaped connector conductor is welded to the first side 20 of the bus bar 14. The complete perimeter of the first portion 16 may be welded to the bus bar 14, if desired, as the weld beads, shown generally at 28, will not interfere with the placement of the coil conductor 10. At least two L-shaped connector conductors are welded to the bus bar, with the specific number employed depending upon how many coil conductors are to be connected to the bus bar. The connector conductors are spaced by the dimension W, i.e., the width dimension of the particular coil conductor to be connected to the bus bar 14.

In the embodiment of the invention shown in FIG. 1, the coil conductor 10 is placed on the second major side or surface 22 of the bus bar 14 with its dimension W between the spaced L-shaped connector conductors 7 and 8, such that the end of the coil conductor 10 is substantially aligned or flush with the outermost surfaces 30 and 32 of the second portions of the connector conductors 7 and 8, respectively. A fusion of metal is then applied, such as by MIG or TIG arc welding, across the ends of the straps 12 as well as on the adjacent selected portions of the surfaces 30 and 32. This layer of electrically conductive material, which may be an alloy of aluminum, or other suitable metal, is shown in phantom at 34.

While the length of the second portions 18 of the L-shaped members may be selected to accommodate the largest dimension H which will be encountered, the L-shaped members may be constructed with different lengths to match the H dimension of the various coil conductors to be connected to a bus bar. Thus, as illustrated in FIG. 2, L-shaped connector conductors 7', 8' and 9' may be selected such that the end surfaces 36, 38 and 40, respectively, are aligned with the upper surface of the coil conductor 10. It would also be suitable to manufacture one size of L-shaped connector conductor, and then cut off the ends of the L-shaped connector conductors flush with the top portion of the coil conductor 10. This arrangement makes the terminal connection more compact, and, as illustrated in FIG. 2, the fusion of metal 34' may extend across the ends 36 and 38 and the surfaces of the straps 12 which lie in the same plane and which are disposed between the ends 36 and 38.

If the openings 26 and the bus bar 14 are such that the coil conductor 10 would cause interference with them if the coil conductor 10 extends across the second side 22 of the bus bar 14, as in the embodiment shown in FIGS. 1 and 2, the embodiment of the invention shown in FIG. 3 may be used. In this embodiment, the coil conductor 10 is placed between the L-shaped connector conductors 7 and 8 such that its end is aligned with the surfaces of the second portions 18 which face the bus bar 14.

Figure 4:
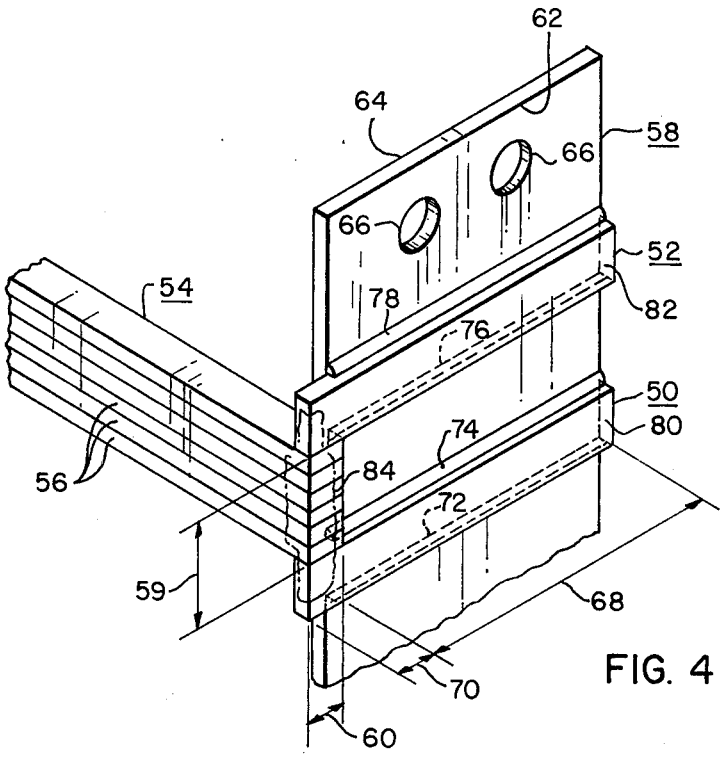
FIGS. 4 and 5 are perspective views of electrical connections utilizing elongated I-shaped connector conductors according to still other embodiments of the invention.
Figure 5:
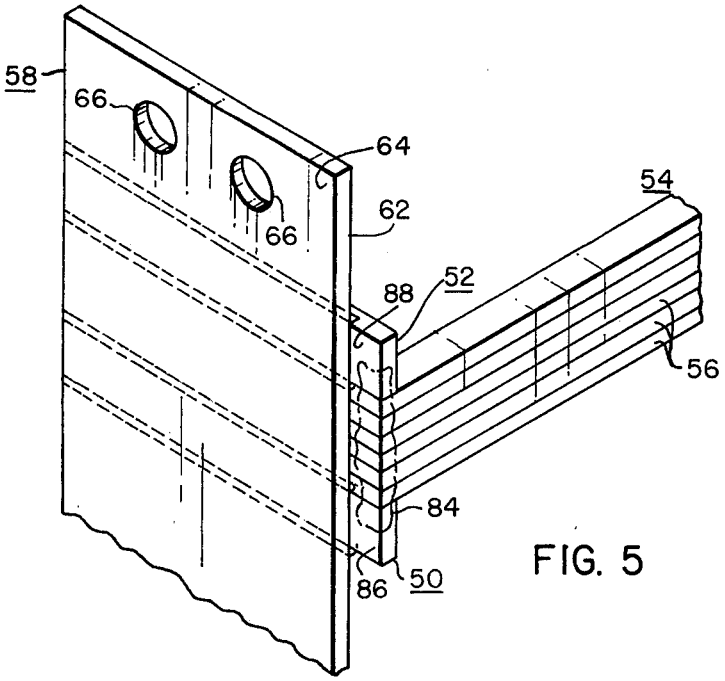

FIGS. 4 and 5 are perspective views of conductor connections constructed according to embodiments of the invention which utilizes a plurality of straight, elongated I-shaped aluminum connector conductors, such as I-shaped connector conductors 50 and 52, to connect a coil conductor 54 having a plurality of aluminum strap conductors 56 to an aluminum bus bar 58. The plurality of strap conductors 56 of coil conductor 54 are assembled with their ends substantially aligned to define a substantially rectangularly shaped composite end portion having the dimensions indicated at 59 and 60.

The bus bar 14 is a bar of aluminum having a rectangular cross-sectional configuration, having first and second major opposed sides or surfaces 62 and 64, respectively, and openings 66 for receiving mounting hardware for receiving and securing electrical leads thereto.

The I-shaped connector conductors 50 and 52 are disposed in spaced relation on the first major side 62 of the bus bar 58, with the spacing being selected to be the dimension 59 of the conductor 54 which is to be snugly accommodated between the connectors. The connector conductors have a first portion, indicated by arrow 68, which is in contact with the bus bar 58, and a second portion, indicated by arrow 70, which extends outwardly from the bus bar. the extending portion 70 is preferably selected to extend outwardly from the bus bar for the dimension 60 of the coil conductor 54, but it may exceed this dimension, if desired. The first portions 68 are welded to the bus bar 58, such as indicated by weld beads 72 and 74 for connector conductor 50, and weld beads 76 and 78 for connector conductor 52. More than two I-shaped connector conductors may be welded to the bus bar, if additional coil conductors are to be connected thereto.

In the embodiment of FIG. 4, the coil conductor 54 is placed between the second portions 70 of connector conductors 50 and 52 such that the end of the coil conductor 54 is flush with the surfaces 80 and 82, which are opposed to the surfaces of connector conductors 50 and 52 which are in contact with the bus bar. A fusion of metal is then applied across the ends of straps 56 and across the adjoining surfaces 80 and 82 of the connector conductors 50 and 52, respectively. The fusion of metal is indicated in phantom at 84. If the length of the second portions 70 is selected to be the same as dimension 60 of the coil conductor 54, the fusion of metal may be extended over the sides of conductor 54 as well as over the extreme ends of connector conductors 50 and 52, as illustrated.

FIG. 5 is a perspective view of an electrical connection which is similar to the connection shown in FIG. 4, except the coil conductor is placed between the second portions 70 of the connector conductors such that its end is aligned with the surfaces 86 and 88 of the connector conductors 50 and 52, respectively, which surfaces are in contact with the first major side 62 of the bus bar 58.

We claim as our invention:

1. An electrical conductor connection, comprising:

a plurality of conductors assembled with their ends aligned to form a substantially rectangularly shaped composite end portion having dimensions W and H, first and second connector conductors each having a plurality of flat surfaces, a bus bar having first and second major opposed sides and connecting edge portions, means connecting first portions of each of said first and second connector conductors to a common side of said bus bar, with second portions of each of said first and second connector conductors extending outwardly from the opposing side of said bus bar, said second portions being spaced by the dimension W, said assembled conductors being disposed only between the second portions of said first and second connector conductors, with like orientations of their W dimensions and with the surface of the composite end portion substantially aligned with selected flat surfaces of the first and second connector conductors, and a fusion of metal across the surface of the composite end portion of the assembled conductors and at least a portion of each of the flat surfaces of the first and second connector conductors aligned therewith.

2. The electrical conductor connection of claim 1 wherein the plurality of conductors, the first and second connector conductors, and the bus bar, are all formed of aluminum.

3. An electrical conductor connection, comprising:

a plurality of conductors assembled with their ends aligned to form a substantially rectangularly shaped composite end portion having dimensions W and H, first and second connector conductors each having first and second portions, said first portions of said first and second connector conductors each being disposed to form a substantially right angle relative to their associated second portions, a bus bar having first and second major opposed sides and connecting edge portions, means connecting said first portions of each of said first and second connector conductors to said first major side of said bus bar, and with said second portions oriented to extend past said second major side, said second portions being spaced by the dimension W, said assembled conductors being disposed only between said second portions of said first and second connector conductors, with like orientations of their W dimensions and with the surface of said composite end portion substantially aligned with selected flat surfaces of said first and second connector conductors, and a fusion of metal across the surface of said composite end portion of said assembled conductors and at least a portion of each of the flat surfaces of said first and second connector conductors aligned therewith.

4. The electrical conductor connection of claim 3 wherein the second portions of the first and second connector conductors have first flat surfaces in a first common plane, which surfaces are immediately adjacent to the bus bar, and opposed flat surfaces in a second common plane, with the surfaces of the composite end portion of the assembled conductors being in the first common plane.

5. The electrical conductor connection of claim 3 wherein the second portions of the first and second connector conductors have first flat surfaces in a first common plane, which surfaces are immediately adjacent to the bus bar, and opposed flat surfaces in a second common plane, with the surface of the composite end portion of the assembled conductors being in the second common plane.

6. The electrical conductor connection of claim 3 wherein the second portions of the first and second connector conductors extend past the second major surface of the bus bar for the dimension L.

7. The electrical conductor connection of claim 6 including a fusion of metal across the surfaces of the outwardly extending ends of the second portions of the first and second connector conductors, and across the aligned flat surfaces of assembled electrical conductors in a common plane therewith.

8. The electrical conductor connection of claim 1 wherein the second portions extend outwardly from the bus bar for the dimension L, such that the surfaces of the ends of the second portions are in a common plane with certain flat surfaces of the assembled electrical conductor, and including a fusion of metal disposed across selected portions of the surfaces in this common plane.

9. An electrical conductor connection, comprising:

a plurality of conductors assembled with their ends aligned to form a substantially rectangularly shaped composite end portion having dimensions W and H, first and second connector conductors each having a plurality of flat surfaces, a bus bar having first and second major opposed sides and connecting edge portions, means connecting said first portions of each of said first and second connector conductors to a common side of said bus bar, with said second portions of each of said first and second connector conductors extending outwardly from said bus bar, said second portions being spaced by the dimension W, said assembled conductors being disposed only between said second portions of said first and second connector conductors, with like orientations of their W dimensions and with the surface of said composite end of said assembled electrical conductors in a common plane with the surface of said bus bar to which said first and second electrical connector conductors are connected, and a fusion of metal across the surface of said composite end portion of said assembled conductors and at least a portion of each of the flat surfaces of said first and second connector conductors aligned therewith.

10. An electrical conductor connection, comprising:

a plurality of conductors assembled with their ends aligned to form a substantially rectangularly shaped composite end portion having dimensions W and H, first and second connector conductors each having a plurality of flat surfaces, a bus bar having first and second major opposed sides and connecting edge portions, means connecting said first portions of each of said first and second connector conductors to a common side of said bus bar, with said second portions of each of said first and second connector conductors extending outwardly from said bus bar, said second portions being spaced by the dimension W, said assembled conductors being disposed only between said second portions of said first and second connector conductors, with like orientations of their W dimensions and with the surface of said composite end of said assembled electrical conductors in a common plane with the surfaces of said first and second electrical connector conductors which are opposed to those surfaces of said first and second electrical connector conductors which are in contact with said bus bar, and a fusion of metal across the surface of said composite end portion of said assembled conductors and at least a portion of each of the flat surfaces of said first and second connector conductors aligned therewith.

* * * * *